United States Patent [19]

Ochiai et al.

[11] Patent Number: 4,473,415

[45] Date of Patent: Sep. 25, 1984

[54] METHOD OF MANUFACTURING AN AMORPHOUS MAGNETIC ALLOY

[75] Inventors: Yoshitaka Ochiai; Yoshimi Makino; Koichi Aso; Satoru Uedaira, all of Yokohama; Masatoshi Hayakawa, Chigasaki; Kazuhide Hotai, Yokohama, all of Japan

[73] Assignee: Sony Corporation, Tokyo, Japan

[21] Appl. No.: 451,196

[22] Filed: Dec. 20, 1982

[30] Foreign Application Priority Data

Dec. 21, 1981 [JP] Japan ..... 56-206347

[51] Int. Cl.[3] ..... C21D 1/04

[52] U.S. Cl. ..... 148/108; 148/31.55

[58] Field of Search ..... 148/108, 31.55

[56] References Cited

U.S. PATENT DOCUMENTS

| | | | |
|---|---|---|---|
| 4,116,728 | 9/1978 | Becker et al. | 148/108 |
| 4,268,325 | 5/1981 | O'Handley et al. | 148/108 |
| 4,312,683 | 1/1982 | Sakakima et al. | 148/108 |
| 4,379,004 | 5/1983 | Makino et al. | 148/108 |

FOREIGN PATENT DOCUMENTS

| | | | |
|---|---|---|---|
| 56-44746 | 4/1981 | Japan | 148/108 |
| 56-69360 | 6/1981 | Japan | 148/108 |
| 57-14646 | 7/1982 | Japan | 148/108 |
| 2088415 | 6/1982 | United Kingdom | 148/108 |

*Primary Examiner*—John P. Sheehan

*Attorney, Agent, or Firm*—Hill, Van Santen, Steadman & Simpson

[57] ABSTRACT

A method of manufacturing an amorphous magnetic alloy having high permeability comprises the steps of:

preparing an amorphous magnetic alloy ribbon having major surfaces;

annealing said magnetic alloy ribbon at a temperature lower than the crystallization temperature of said alloy under the application of a first magnetic field in a first direction along said major surface for a period sufficient to induce a magnetic anisotropy in said first direction; and annealing said magnetic alloy ribbon at a temperature lower than the crystallization temperature of said alloy under the application of a second magnetic field in a second direction perpendicular to said first direction along said major surface until the induced magnetic anisotropies in said first and second directions become equal to each other.

1 Claim, 2 Drawing Figures

METHOD OF MANUFACTURING AN AMORPHOUS MAGNETIC ALLOY

BACKGROUND OF THE INVENTION

1. Field of the Invention

The present invention relates to a method of manufacturing an amorphous magnetic alloy having high permeability, and more particularly it relates to a method of manufacturing the amorphous magnetic alloy having high permeability by annealing an amorphous magnetic alloy ribbon in a magnetic field at a temperature lower than the crystallization temperature.

2. Description of the Prior Art

Amorphous magnetic alloys manufactured by rapid quenching or electro- or electroless plating have low permeability ($\mu$) and it is therefore impossible to use them as they are as soft magnetic materials. Hereinafter the amorphous magnetic alloy so manufactured without additional treatment is referred to as unmodified magnetic alloy.

OBJECTS AND SUMMARY OF THE INVENTION

It is an object of the present invention to provide a method of manufacturing an amorphous magnetic alloy having high permeability.

It is another object of the present invention to provide a method of annealing an unmodified amorphous magnetic alloy in a magnetic field to improve the permeability of the unmodified amorphous magnetic alloy.

It is a further object of the present invention to provide a method of annealing an unmodified amorphous magnetic alloy in a magnetic field to release it from any induced magnetic anisotropy.

According to one aspect of the present invention, there is provided a method of manufacturing an amorphous magnetic alloy having high permeability comprising the steps of:

preparing an amorphous magnetic alloy ribbon having major surfaces;

annealing said magnetic alloy ribbon at a temperature lower than the crystallization temperature of said alloy under the application of a first magnetic field in a first direction along said major surface for a period sufficient to induce a magnetic anisotropy in said first direction; and annealing said magnetic alloy ribbon at a temperature lower than the crystallization temperature of said alloy under the application of a second magnetic field in a second direction perpendicular to said first direction along said major surface until the induced magnetic anisotropies in said first and second directions become equal to each other.

DESCRIPTION OF THE PREFERRED EMBODIMENTS

The permeability of a soft magnetic alloy is determined by magnetic anisotropy (K). In the case of an amorphous magnetic alloy, in particular, a main factor which determines the permeability is the anisotropy $K=3/2\ \lambda\sigma$ with a magnetostriction ($\lambda$) combined with an internal stress ($\sigma$), which has been caused in the alloy during the manufacture For this reason, magnetic alloys to be chosen as soft magnetic core materials such as used for magentic heads must have a composition for zero magnetostriciton ($\lambda \cong 0$). However, with the unmodified amorphous magnetic alloy having a composition for zero magnetostriction, it is impossible to attain high permeability. The conceivable cause is the anisotropy which has been induced in the alloy during the manufacture, that is, the induced magnetic anisotropy.

Figure 1:
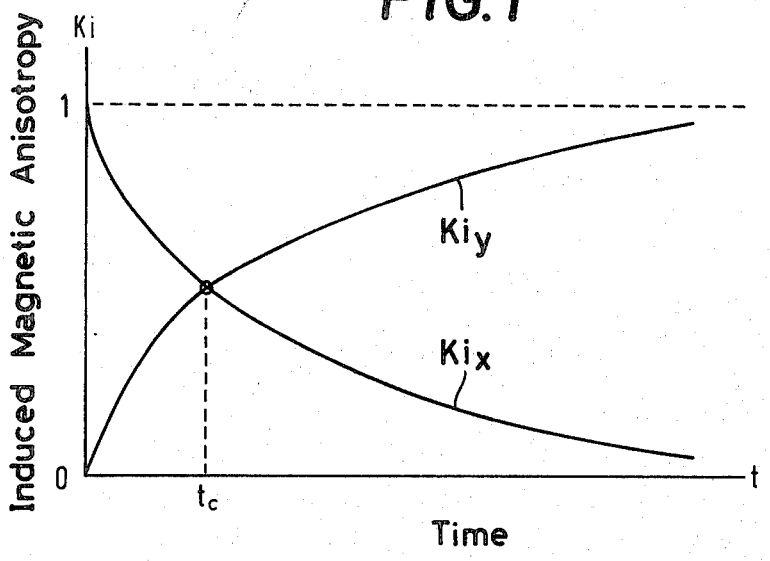
FIG. 1 is a graph showing the temperature variation of the magnetic anisotropy in the x and y directions of an amorphous magnetic alloy.

The permeability ($\mu$) is in general related to the magnetic anisotropy in the form of $\mu \propto 1/\overline{K}$ or $\mu \propto 1/\sqrt{}$, depending on magnetization process. Thus, with an alloy of zero magnetostriction, high permeability can be attained when the induced magnetic anisotropy is made as low as possible. Since the induced magnetic anisotropy Ki is a scalar quantity, if annealing is conducted in a magnetic field so as to induce in the alloy a second induced magnetic anisotropy Ki which is perpendicular to the direction of and has the same magnitude as a first induced magnetic anisotropy Ki of the unmodified amorphous magnetic alloy, the first induced magnetic anisotropy is decreased and at the same time the second induced magnetic anisotropy grows perpendicular to the direction of the first induced magnetic anisotropy and parallel to the applied magnetic field until a point is reached where apparently there is no induced magnetic anisotropy within the alloy. FIG. 1 indicates that when the direction of the first induced magnetic anisotropy of the alloy is taken to be the x direction and its magnitude to be $Ki_x$, and the magnitude of the second induced magnetic anisotropy in the y direciton perpendicular to the x direction is taken to be $Ki_y$, if a magnetic field is applied in the y direction, the $Ki_x$ is decreased and the $Ki_y$ is increased until the $Ki_x$ and $Ki_y$ become equal in the magnitude. At this point, $t=t_c$ (critical time), the relation $Ki_x=Ki_y$ holds good and physically the alloy becomes as if it has no induced magnetic anisotropy, and a high permeability can thus be attained In addition, even when there is in the alloy the anisotropy $K=3/2\ \lambda\sigma$ connected to the magnetostriction ($\lambda$), the stress in the alloy is removed through the annealing, with the result of the decrease in the anisotropy. In other words, the critical time $t_c$ is of temperature dependence and can be determined by measuring the change in the induced magnetic anisotropy. Thus, critical times, $t=t_c$, at different temperatures can be determined, for example, using magnetization curve, a torque meter, and magnetic resonance.

It suffices that the temperature at which the amorphous magnetic alloy is annealed is below the crystallization temperature of the alloy and above a temperature at which the induced magnetic anisotropy can be created. More concretely, the annealing temperature, although varying depending on the composition of the unmodified amorphous magnetic alloy to be used, may be above 100° C., and, as for the annealing time, the shortest possible time is preferred for industrial operations. The temperature and time are suitably determined in accordance with the measurements of the critical time $t_c$ at each temperature at which a desired permeability is obtained.

The amorphous magnetic alloy obtainable in accordance with the method of the present invetion has a remarkably high permeability.

In the following the invention will be described in detail by way of an example.

EXAMPLE

A ribbon 23–24μm thick of an amorphous alloy of $Fe_5Co_{75}Si_4B_{16}$ (in atomic ratio) was prepared by single roller method, in which a molten mother metal was subjected to rapid quenching on a rotating roller, and the resulting amorphous state of the alloy was checked by the X-ray diffraction pattern. The crystallization and Curie temperatures were found to be 420° C. and 590° C., respectively.

Figure 2:
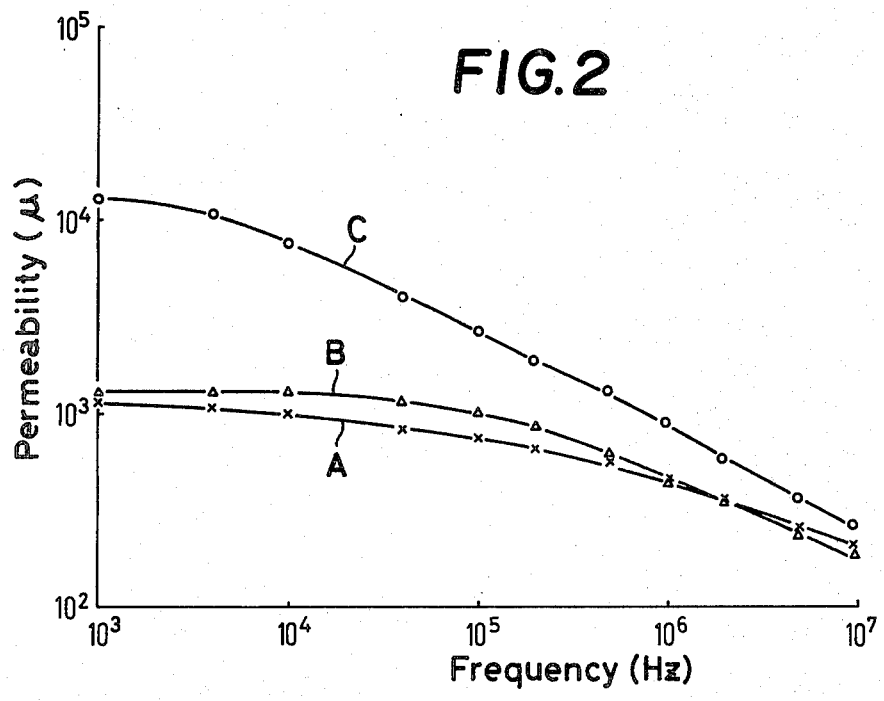
FIG. 2 is a graph showing the $\mu$-f curves for the sample alloys obtained at different stages of the treatment in the Example.

The ribbon was cut to prepare samples, about 1 cmx 1 cm. In FIG. 2 the frequency dependence of the permeability of the thus prepared alloy is shown by curve A (μ-f curve).

In order to eliminate strains and non-uniform anisotropies caused in the sample alloy during the preparation, a magnetic field of $H_a=2.4$ $KO_e$ was applied to the samples in one direction (hereinafter referred to as the X direction) at a temperature of $T_a=370°$ C. for $t_a=10$ minutes for annealing them in the magnetic field to give them an induced magnetic anisotropy in the x direction. The μ-f curve for the resulting sample is indicated by B in FIG. 2.

The samples thus given the induced magnetic anisotropy in the x direction were then subjected to a crossed-field annealing by applying a magnetic field of $H_a=2.4$ KOe in the direction (hereinafter referred to as the y direction) perpendicular to the x direction at a temperature of $T_a=280°$ C. for a period of $t_a=30$ minutes, that is, under a condition that the relation $Ki_x=Ki_y$ was satisfied at t=tc (critical time). Eight pieces of the samples (each 23–24 μm thick) so annealed were stacked and stamped to rings each 10 mm in outer diameter and 6 mm in inner diameter using an ultrasonic cutter. The μ-f curve for the ring sample is indicated by C in FIG. 2.

From the results shown in FIG. 2 it has been found that the resulting amorphous magnetic alloy annealed in the magnetic field in accordance with the method of the present invention has a remarkably improved permeability (μ). For example, in the case shown in FIG. 2, the amorphous magnetic alloy annealed in accordance with the present invention has a permeability (μ) about twelve times at a frequency of 1 KHz and about two times even at a frequency of 1 MHz as high as that of the amorphous magnetic alloy before annealing.

While a preferred embodiment has been described, variations thereto will occur to those skilled in the art within the scope of the present invention concepts which are delineated by the following claim.

What is claimed is:

1. A method of manufacturing an amorphous magnetic alloy having high permeablility comprising the steps of:

preparing an amorphous magnetic alloy ribbon having major surfaces;

annealing said magnetic alloy ribbon at a temperature lower than the crystallization temperature of said alloy under the application of a first magnetic field in a first direction along one major surface for a period sufficient to induce a magnetic anisotropy in said first direction; and annealing said magnetic alloy ribbon after termination of the application of said first magnetic field at a temperature lower than the crystallization temperature of said alloy under the application of a second magnetic field in a second direction perpendicular to said first direction along said major surface until the induced magnetic anisotropies in said first and second directions become equal to each other.

* * * * *